US006829917B2

(12) United States Patent
Russell

(10) Patent No.: US 6,829,917 B2
(45) Date of Patent: Dec. 14, 2004

(54) GRAVITY-SENSITIVE LOCKING ASSEMBLY AND WEAPON CONTAINER

(76) Inventor: Rodney O. Russell, 1240 Hampton Hall Dr., Atlanta, GA (US) 30319-1914

( * ) Notice: Subject to any disclaimer, the term of this patent is extended or adjusted under 35 U.S.C. 154(b) by 30 days.

(21) Appl. No.: 10/347,730

(22) Filed: Jan. 21, 2003

(65) Prior Publication Data

US 2003/0159954 A1 Aug. 28, 2003

Related U.S. Application Data

(60) Provisional application No. 60/349,908, filed on Jan. 18, 2002.

(51) Int. Cl.[7] ..... B65D 55/14

(52) U.S. Cl. ..... 70/162; 70/63; 292/183; 292/DIG. 4; 206/1.5; 206/317

(58) Field of Search ..... 70/63, 159–162; 292/92, 137, 163–167, 183–184, 186, 188, DIG. 4, DIG. 65; 206/1.5, 315.11, 317

(56) References Cited

U.S. PATENT DOCUMENTS 1,941,150 A * 12/1933 Meyer ..... 70/160
3,307,755 A * 3/1967 Lentz ..... 206/317
4,155,584 A 5/1979 Pracchia ..... 294/68.26
4,721,205 A * 1/1988 Burt et al. ..... 206/317
4,838,626 A 6/1989 Parr ..... 312/333
5,172,575 A * 12/1992 Fisher ..... 70/63
5,236,086 A * 8/1993 MacTaggart ..... 206/317
5,791,173 A * 8/1998 Montes ..... 70/101
5,848,092 A 12/1998 Mitsumot et al. ..... 372/107
5,901,589 A * 5/1999 Cordero ..... 70/63
6,081,186 A * 6/2000 Adams ..... 70/158
6,260,300 B1 * 7/2001 Klebes et al. ..... 70/63
6,488,148 B1 * 12/2002 Woodson ..... 206/317
6,570,501 B2 * 5/2003 Bushnell et al. ..... 206/1.5

* cited by examiner

*Primary Examiner*—John Walsh
*Assistant Examiner*—Christopher Boswell
(74) *Attorney, Agent, or Firm*—Needle & Rosenberg, PC.

(57) ABSTRACT

A weapon container and lock assembly for mounting in a vehicle, for example, an aircraft, that may be subject to a positive accelerated gravity environment. The weapon container has a container body defining an interior cavity therein and a top lid that is selectively moved between an open position and a closed position with respect to the container body by a container opening assembly. A lock assembly is provided for movement between a first, locked, position and a second, unlocked, position upon application of an accelerated gravity condition of a predetermined level. In use, the lock assembly prevents movement of the container opening assembly when the lock assembly is in the first position and allows movement of the container opening assembly when the lock assembly is in the second position.

19 Claims, 11 Drawing Sheets

GRAVITY-SENSITIVE LOCKING ASSEMBLY AND WEAPON CONTAINER

This application claims priority to U.S. Provisional Application Ser. No. 60/349,908 filed Jan. 18, 2002, which is incorporated herein by reference in its entirety.

FIELD OF THE INVENTION

This invention relates to weapon safes, and more particularly to weapon containers which are locked in a closed configuration by a concealed, gravity-actuated locking assembly that remains locked until the container is placed in an accelerated, positive gravity environment.

SUMMARY

The present invention provides a weapon container for mounting in a vehicle, such as, for example, an aircraft, that may be subject to a positive accelerated gravity environment. The weapon container has a container body defining an interior cavity therein and a top lid that is selectively moved between an open position and a closed position respective to the container body by a container opening assembly. A lock assembly is also provided for movement between a first, locked, position and a second, unlocked, position upon application of an accelerated gravity condition of a predetermined level. In use, the lock assembly prevents movement of the container opening assembly when the lock assembly is in the first position and allows movement of the container opening assembly when the lock assembly is in the second position.

In one embodiment, the lock assembly comprises a mounting plate, a locking member, a lever member, and a knuckle assembly. If used, the mounting plate is affixed to a portion of an interior surface of the interior cavity. The mounting plate has a first mounting pin that extends away from the plate and a second mounting pin spaced from the first mounting pin that also extends away from the plate. The locking member has a first end, an opposed second end, and a longitudinal axis L. At least a portion of the first end of the locking member is in selective operable contact with a portion of the container opening assembly. In use, the locking member moves along the longitudinal axis L between an extended position and a collapsed position.

The lever member has a distal end, an opposed proximal end, an upper surface and a longitudinal axis W. The lever member also defines a bore near the proximal end of the lever member that receives the first mounting pin to pivotally connect the lever member to the first mounting pin of the mounting plate. The distal end of the lever member has a weight attached thereto. The lever member also has an actuation arm that extends away from the proximal end and above the upper surface of the lever member. An end portion of the lever member may bend inward toward the distal end of the lever member as it extends away. In use, the lever member moves rotationally about the first mounting pin upon the application of the predetermined level of the accelerated gravity condition.

The knuckle assembly has a mounting member, a first member, and a second member. The mounting member has a first mounting end, an opposed second mounting end, and a third mounting end that is intermediate the first and second mounting ends. The first mounting pin is connected to the first mounting end and the second mounting pin is connected to the second mounting end so that the mounting member is fixed relative to the mounting plate. The first member is pivotally connected to the second member to form a first joint. One end of the first member is pivotally connected to a portion of the second end of the locking bar member to form a second joint and one end of the second bar member is pivotally connected to the third mounting end of the mounting member to form a third joint. The respective second and third joints are substantially co-axial with respect to the longitudinal axis L of the locking bar assembly.

In use, the lock assembly moves between the first, locked, position and the second, unlocked, position upon application of the accelerated gravity condition of the predetermined level. The top lid is locked closed with respect to the container body such that the interior cavity of the weapon container is substantially enclosed when the lock assembly is in the first position. The top lid may be moved to open the weapon container, via operator actuation of the container opening assembly, when the lock assembly is in the second position.

BRIEF DESCRIPTION OF THE DRAWINGS

These and other features and aspects of the present invention will become better understood with reference to the following description, appended claims, and accompanying drawings, where:

DETAILED DESCRIPTION OF THE INVENTION

Figure 2:
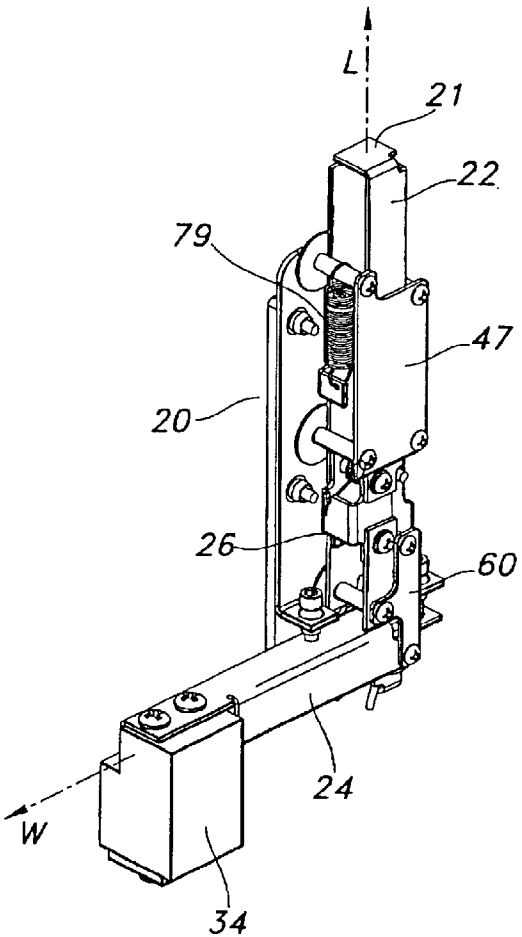
FIG. 2 is a perspective view of the first embodiment of a gravity sensitive lock assembly shown in FIG. 1.
Figure 1:
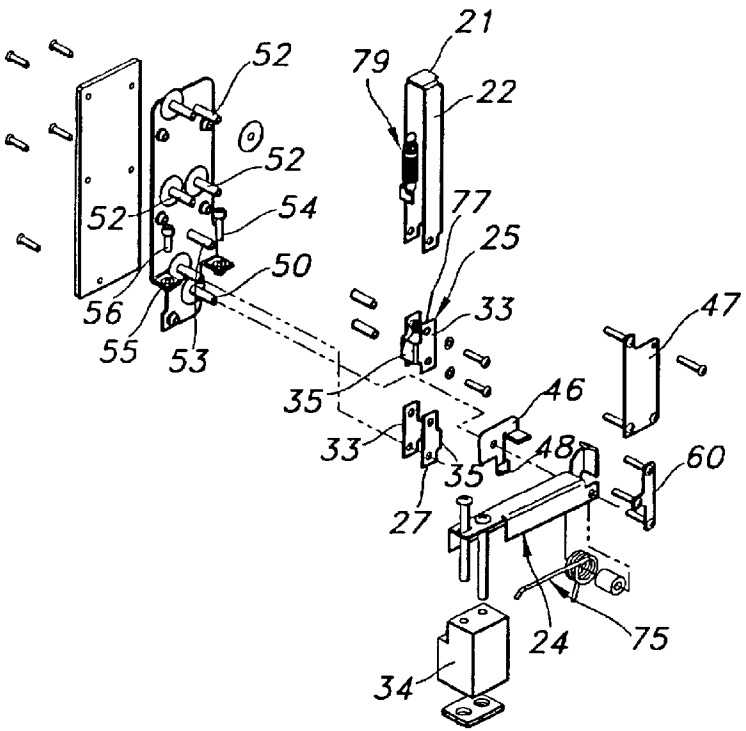
FIG. 1 is an exploded perspective view of a first embodiment of a gravity sensitive lock assembly for a weapon container, the lock assembly having a locking bar member, a lever member, and a knuckle assembly connected intermediate the locking bar member and the lever member, the lock assembly shown in a first, locked, position.
Figure 4:
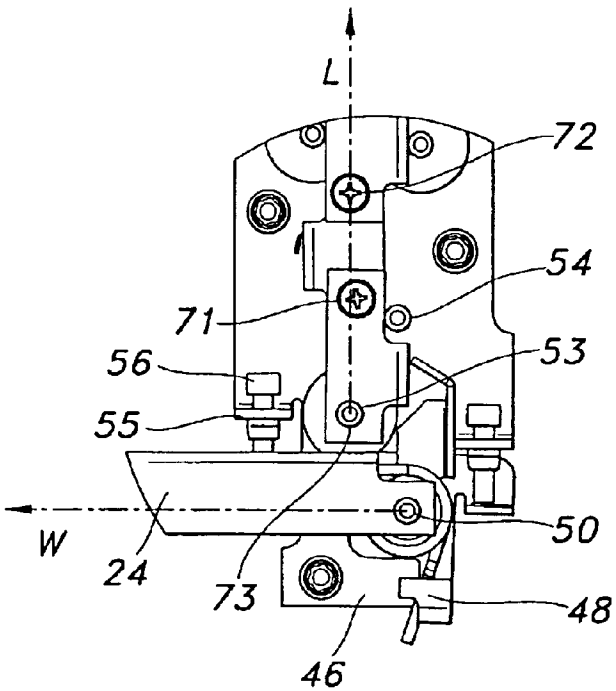
FIG. 4 is a partial front view of the knuckle assembly when the first embodiment of the lock assembly is in the first position.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Figure 7:
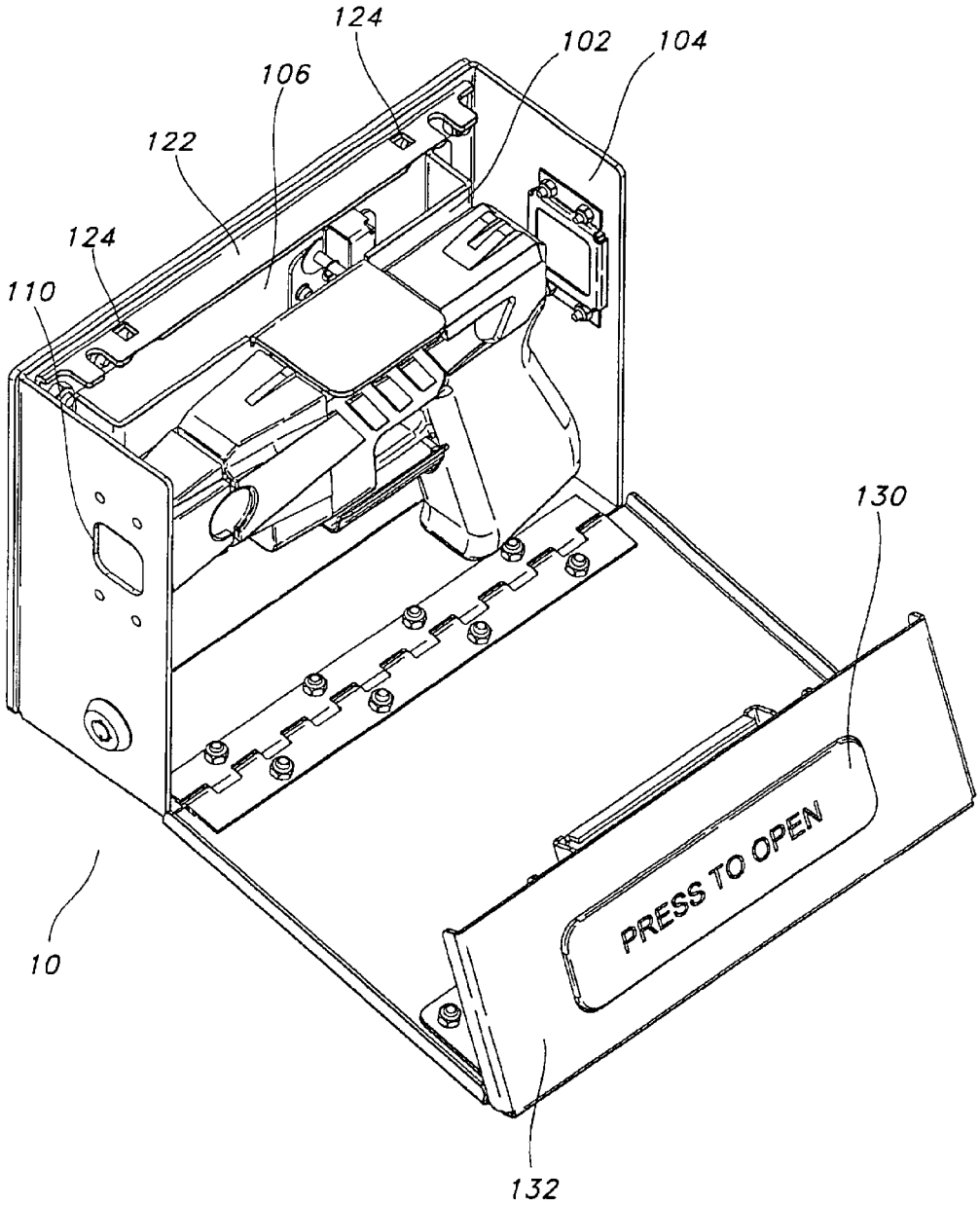
FIG. 7 is a perspective view of a first embodiment of a weapon container having a container opening assembly operatively connected to the first embodiment of the gravity sensitive lock assembly, the weapon container shown in an open configuration.
Figure 8:
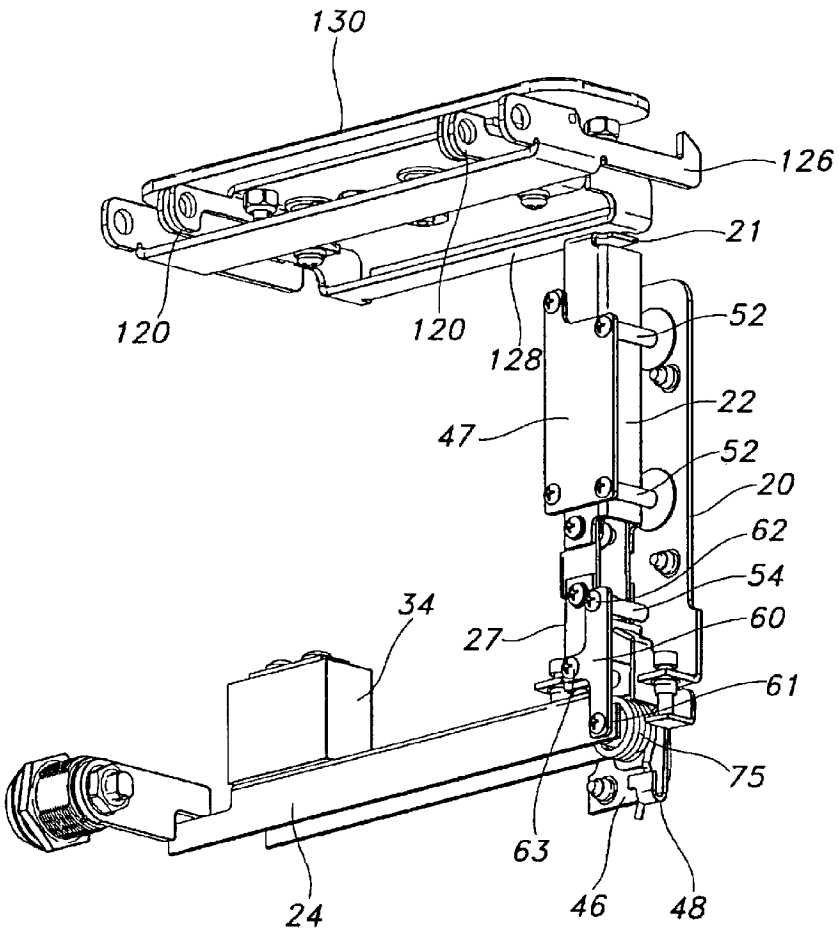
FIG. 8 is a partial perspective view of the first embodiment of the weapon container showing a key lock in operable contact with the lock assembly for auxiliary service access to the weapon container in the absence of an accelerated gravity condition, the gravity sensitive lock assembly shown in the first, locked, position and in contact with a portion of the container opening assembly of the weapon container.
Figure 11:
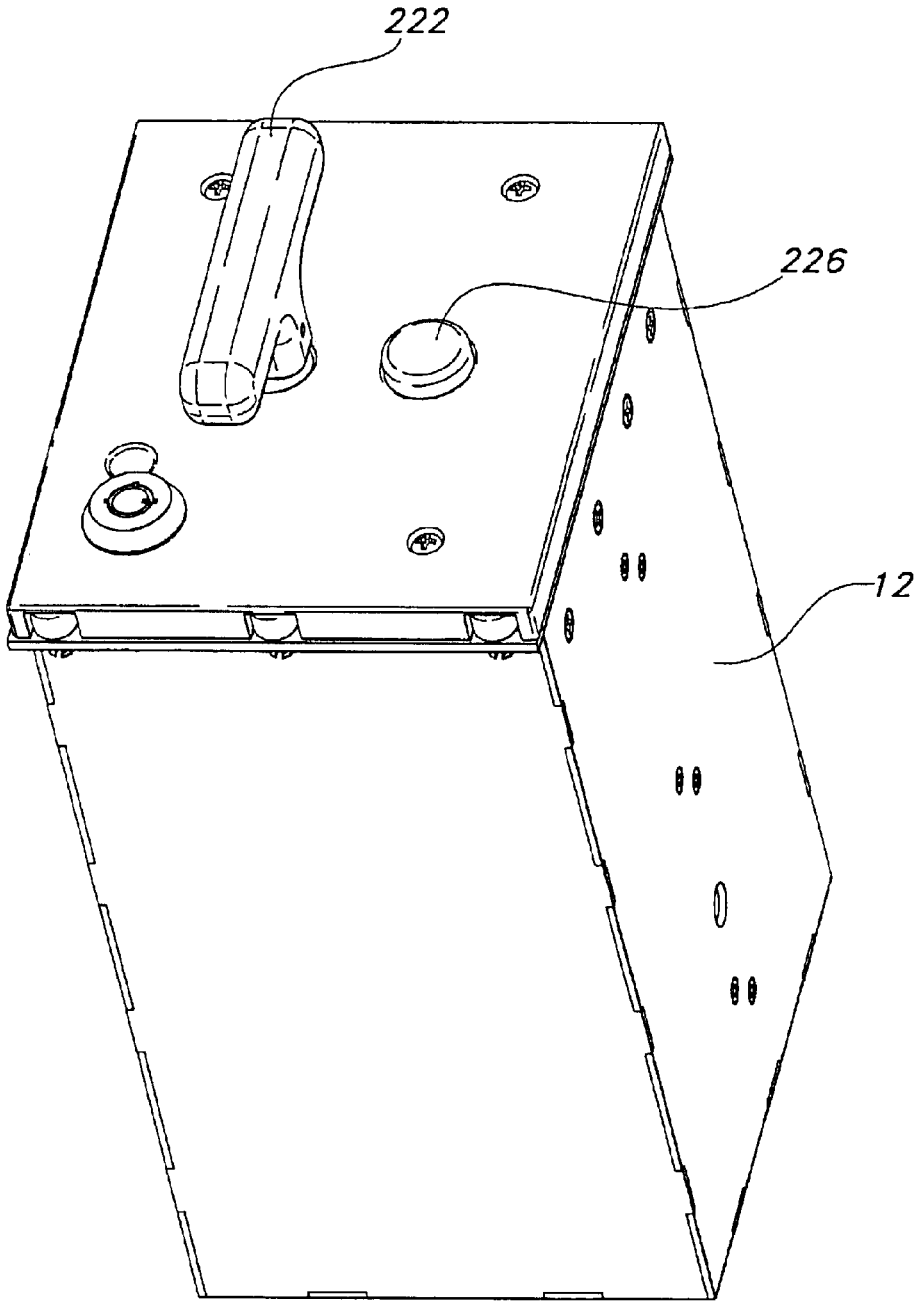
FIG. 11 is a perspective view of a second embodiment of a weapon container having a container opening assembly operatively connected to the first embodiment of the gravity sensitive lock assembly, the weapon container shown in a closed configuration.
Figure 12A:
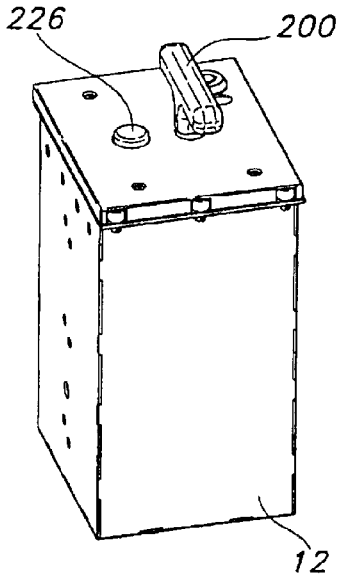
FIGS. 12A–12D are perspective views of the second embodiment of the weapon container, the weapon container shown moving from a closed to an open configuration.
Figure 12B:
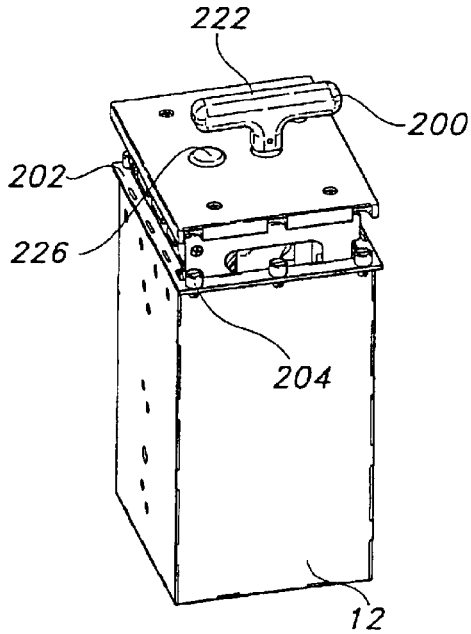
Figure 12C:
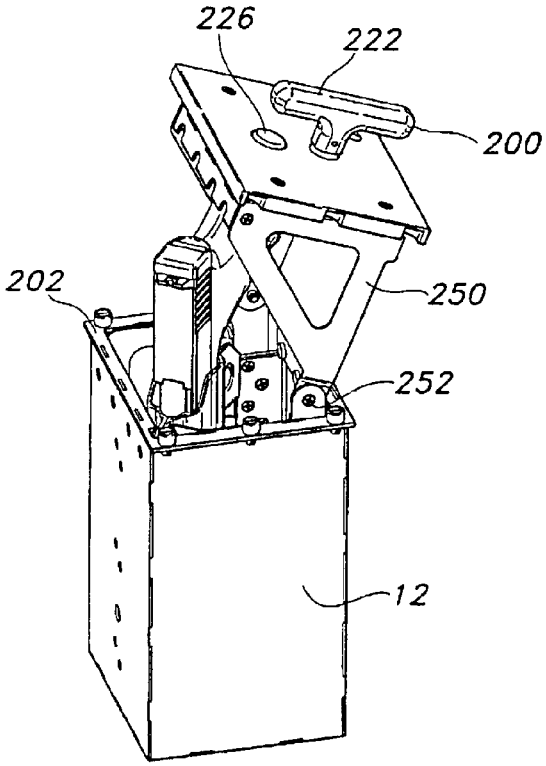
Figure 12D:
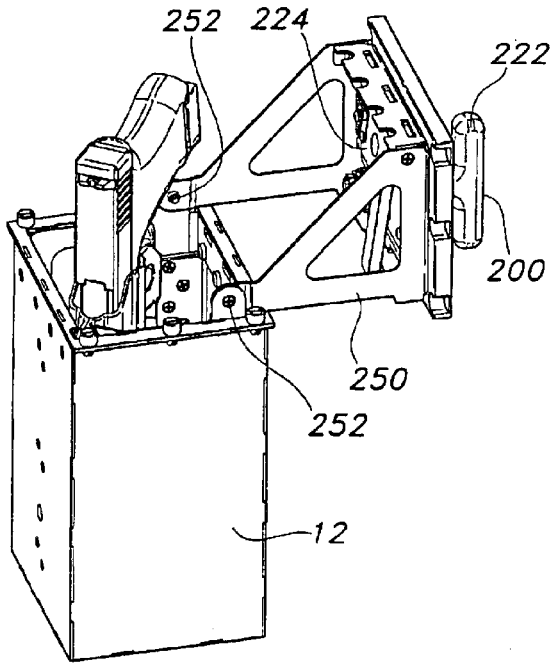
Figure 13B:
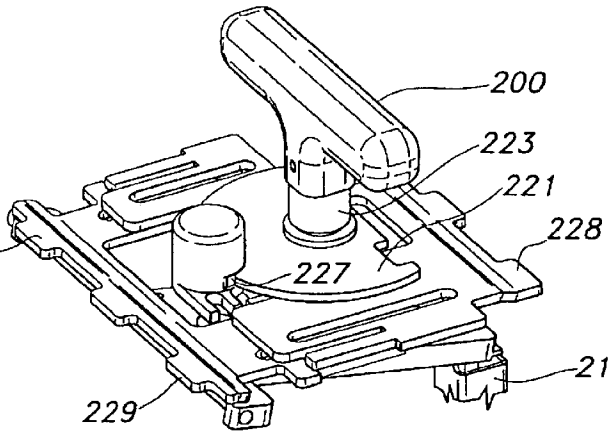
FIGS. 13A–13D are perspective views of the second embodiment of the weapon container, the first embodiment of the lock assembly in operable contact with a portion of the container opening assembly, the container opening assembly having at least one latch plate in operable connection with a portion of the walls of the weapon container, the opening assembly shown moving from a first, latched, position wherein the lock assembly is in the first, locked, position, to a second, unlatched, position wherein the lock assembly is in the second, unlocked, position.
Figure 13A:
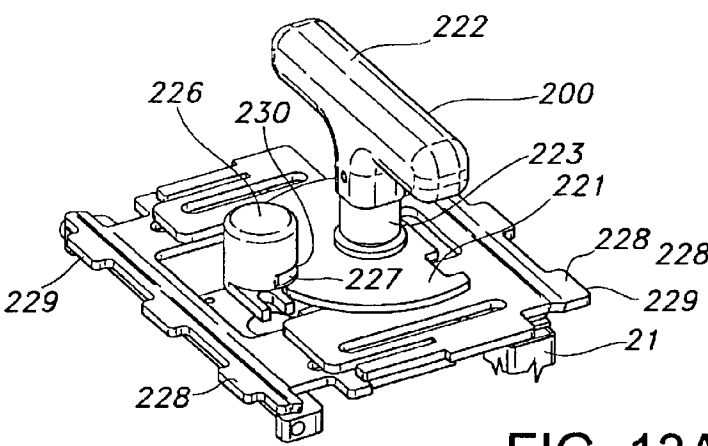
Figure 13D:
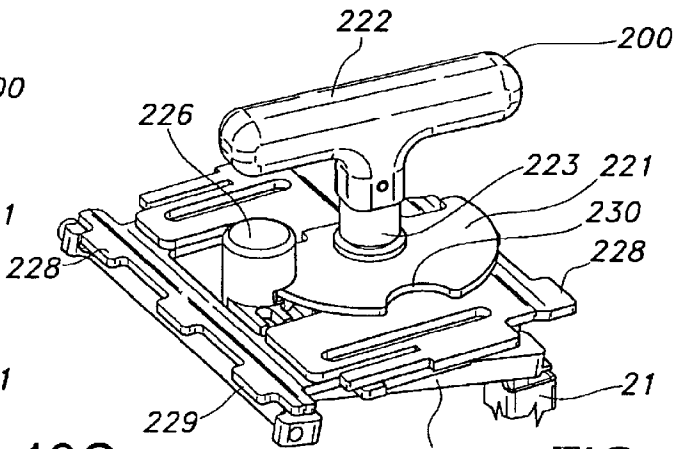
Figure 13C:
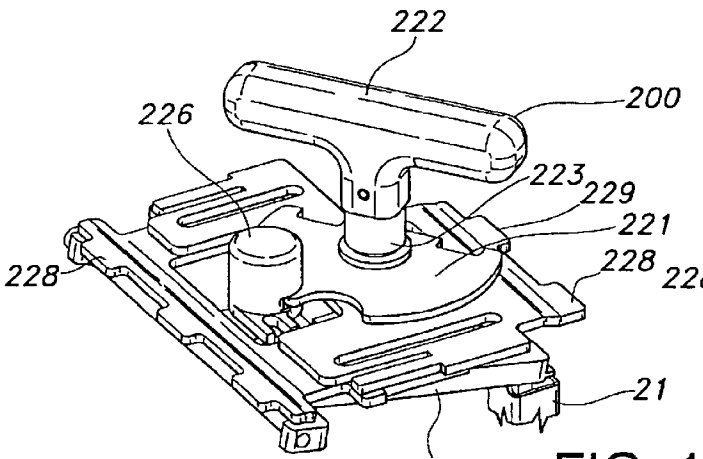

Turning now to the drawings and particular FIGS. 7 and 11, a weapon container is enumerated generally as at 10. Although the invention described herein can be advantageous for use with any kind of weapon container that can be exposed to a positive accelerated gravity environment, it will find its most common utility with an aircraft mounted weapon container in which a lethal or non-lethal weapon is stored.

Referring to FIGS. 1–6, a first embodiment of a gravity sensitive lock assembly 20 that is movable between a first, locked, position and a second, unlocked, position upon application of an accelerated gravity condition of sufficient magnitude is shown. The first embodiment of the lock assembly 20 has a locking member 22, a lever member 24, and a knuckle assembly 26 pivotally connected intermediate the locking bar member 22 and the lever member 24. The lever member 24 has an upper surface 31, a distal end 30, an opposed proximal end 32, and defines a longitudinal axis W. The proximal end 32 of the lever member 24 is pivotally connected to a substantially upright planar mounting plate 40 via a first mounting pin 50. As shown in the figures, the first mounting pin 50 extends therethrough a first bore 28 defined in the lever member 24 near the proximal end of the lever member 24.

A shoulder stop 55 that extends from the mounting plate may be provided. In one example, the shoulder stop is constructed and arranged to receive an adjustable fastener 56 such as, for example, a screw or bolt which moves on an axis parallel to the mounting plate. As one will appreciate, the mounting plate 40 may comprise at least a portion of the interior surface of the interior cavity of the weapon container.

The proximal end of the lever member also includes an actuation arm 40 that extends away therefrom. In one example, an end portion 42 of the actuation arm bends inward toward the distal end of the lever member. The distal end 30 of the lever member 24 includes a weight 34 that is attached thereto. As one skilled in the art will appreciate, the weight 34 may be selectably attached to alternative portions of the distal end 30 of the lever member 24 so that the respective gravitational level at which the lock assembly 20 moves from the first, locked, position to the second, unlocked, position may be selected by the operator. The weight 34 is positioned thereon the distal end 30 of the lever member 24 allows the lever member 24 to pivot downwardly about the first mounting pin 50 upon the application of a positive, accelerated gravity condition of a predetermined level. The relative gravitational level for actuation of the lock assembly 20 may be selected to be, for example, in the range from about 1.1 to 4.5 Gs; more preferably from 1.1 to 3.5 Gs; and still more preferred, from 1.2 to 2.5 Gs. In one example, the distal end 30 of the lever member 24 may have at least one slot 36 extending longitudinally proximate the distal end 24 of the level member 24. The weight 34 can be selectively connected to the slot 36 to provide the desired gravitational level for actuation.

Further, the lock assembly may include a spring plate 46 that is mounted onto the first mounting pin and is fixed to the mounting plate intermediate the mounting plate and the lever member. The spring plate has a spring shoulder stop extending away therefrom. A first spring 75 may be included and is positioned onto the first mounting pin within a channel 44 defined in the lever member so that the first spring 75 is disposed within and acts thereon a portion of the formed channel 44 of the lever member 24 to urge the lever member 24 back into its original position consistent with a normal, unaccelerated, gravity condition. Thus, in this example, the lever member 24 would pivot downwardly about the first mounting pin 50 against the resistance of the first spring 75 upon the application of a positive accelerated gravity condition of sufficient magnitude.

The locking member 22 has a first end 21, an opposed second end 23, and defines a longitudinal axis L. At least a portion of the first end 21 of the locking member 22 may be in selective operable contact with a portion of a container opening assembly. The second end 23 of the locking bar assembly 20 is pivotally connected to a portion of the knuckle assembly 22. Upon application of the targeted gravitational level, the locking member 22 is drawn downwardly along the longitudinal axis L. A plurality of guide pins 52 extending from the mounting plate 40 are connected to a face plate 47 to aid in constraining the locking member 22 to movement along the longitudinal axis L.

The knuckle assembly 26 has a first member 25, a pivotally connected second member 27, and a pivotally connected mounting member 60. In one example, each of the first and second members preferably has a substantially U-shape and is formed from two opposing planar plates 33 joined by a support member 35. Each of the planar plates has an upper end 36 and a lower end 37. In operation, the first member 22 has its upper end pivotally connected to a portion of the second end 23 of the locking member 22, to form a second joint 72 and its lower end is pivotally connected to the upper end of the second member 27, to form a first joint 71.

The mounting member 60 preferably is T-shaped and has a first mounting end 61, an opposed second mounting end 62, and a third mounting end 63 intermediate the first mounting end and the second mounting end. Each of the respective first, second and third mounting ends defining an opening 64 therethrough. As shown in the figures, the first mounting pin 50 extends through and is connected to the first mounting end 61 of the mounting member 60. The locking assembly further comprises a second mounting pin 54 that extends away from the mounting plate and is spaced from the first mounting pin. The second mounting pin is connected to the second mounting end 62 of the mounting member so that the mounting member 60 is fixed relative to the mounting plate. As one will observe, the second mounting pin 54 and first mounting pin 50 are both connected to the mounting plate 40 so that they are offset with respect to the extended longitudinal axis L of the locking bar member 22. In one example, the first and the second mounting pins 50, 54 are positioned substantially parallel to one side of the longitudinal axis L.

The lower end 37 of the second member 27 is pivotally connected to a third mounting pin 53 extending between the third, intermediate end, of the mounting member and the mounting plate to form a third joint 73. As one skilled in the art will appreciate, the respective pivot connections of the first member 25 and the locking member 22 and the second bar member 27 and the mounting member 60, i.e., the second and third joints, are substantially co-axial with respect to the extended longitudinal axis L of the locking member 22.

Thus, in an unaccelerated gravity condition in which the lock assembly 20 is in the first, locked condition, the first joint is oriented offset from the extended longitudinal axis L and outwardly toward the proximal end 32 of the lever member 24 in a first overcenter position. Also, in one example, a portion of the support member of the second member is in resting contact with a portion of the second mounting pin. In an alternative example, a portion of the upper surface 31 of the lever member is in contact with the fastener 56 in the shoulder stop 55 of the mounting plate 40 and the second member is spaced from the second mounting pin 54. Thus, as one will appreciate, in the alternative example, the first joint is less offset and is closer to the longitudinal axis L when in the first overcenter position.

In the first, locked, position of the lock assembly 20, any force downwardly applied to the first end 21 of the locking member 22 would merely force the respective portions of the knuckle assembly 26 against portions of the second mounting pin that constrains the locking member 22 from downward movement resulting from the downward application of force.

In one example, the bore 28 in the lever member 24 for pivotal receipt of the first mounting pin 50 is substantially co-axial to the longitudinal axis W of the lever member 24. The second member 27 is preferable pivotally connected to the mounting member 60 offset from the longitudinal axis W of the lever member 24 and above the upper surface 31 the lever member 24. As one will appreciate, upon the application of the targeted accelerated gravitational condition, the lever member 24 pivots downwardly and around the first mounting pin 50 which causes a portion of the end portion 42 of the actuation arm 40 to push against a portion of the second member 27. As a result, the actuating arm 40 forces the second member 27 away from the first overcenter position toward a second overcenter position in which the pivot connection between the first and second members 25, 27 is oriented offset from the extended longitudinal axis L and outwardly toward the distal end 30 of the lever member 24. In this second overcenter position, the second end 23 of the locking member 22 is drawn downwardly toward the lever member 24 which places the lock assembly into the second, unlocked, position.

The lock assembly 20 may also include a second spring 77 that is connected to a pivot pin joining the upper end of the first member and the second end of the locking member. As one will appreciate, the respective ends of the second spring act of a portion of the locking member proximate the second end and a portion of the support member of the first member to urge the knuckle assembly 26 back to the first overcenter position from the second overcenter position upon the resumption of a normal, unaccelerated, gravitational condition.

The locking assembly may also include a third spring 79. One end of the third spring is connected to a portion of the locking member that is intermediate the first end and second end thereof. The other end of the third spring is connected to one of the guide pins that is near the upper end off the mounting plate (i.e., near the first end of the locking member). The third spring helps to urge the locking member to its extended position from the collapsed position.

Figure 3:
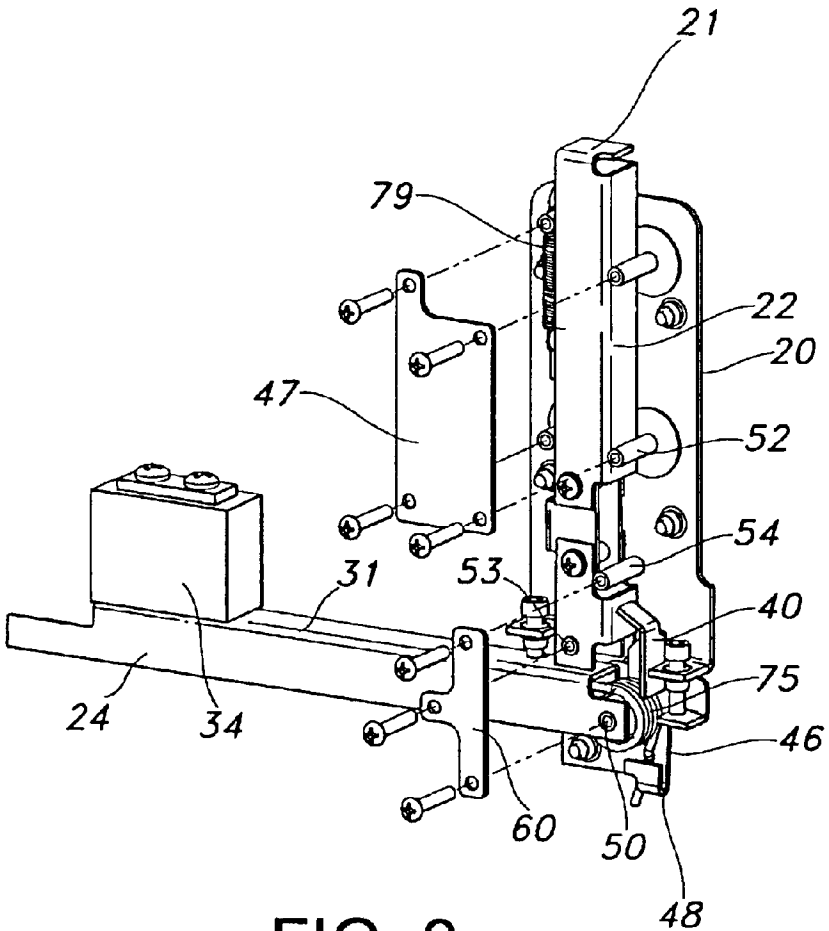
FIG. 3 is a partially-exploded perspective view of the first embodiment of a gravity sensitive lock assembly shown in FIG. 1.
Figure 6:
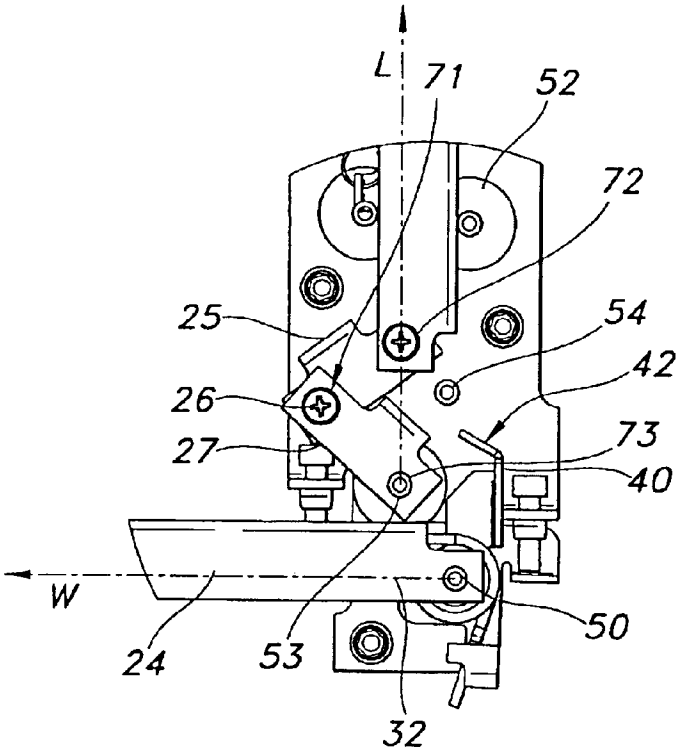
FIG. 6 is a partial cross-sectional front view of the knuckle assembly of the first embodiment of the lock assembly shown in FIG. 2A when the lock assembly is in the second, unlocked, position.
Figure 5:
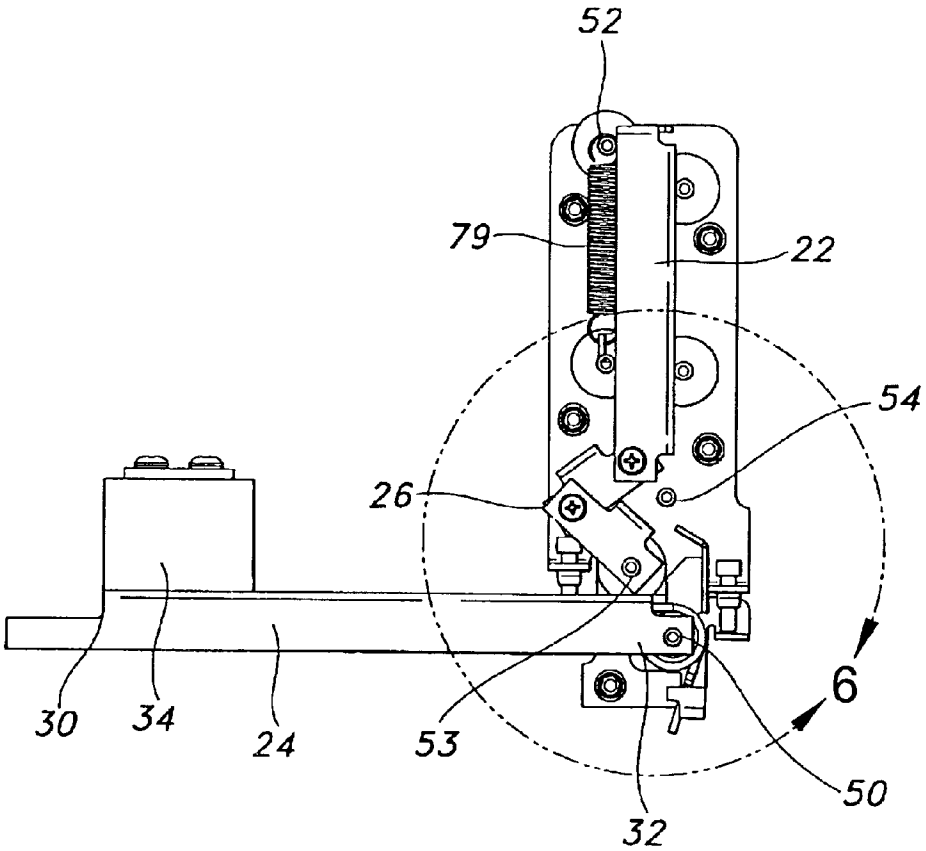
FIG. 5 is a partial cross-sectional view of the first embodiment of the gravity sensitive lock assembly, the lock assembly shown in a second, unlocked, position due to the application of an accelerated gravity condition.

Referring now to FIGS. 7–10, a first embodiment of a weapon container 10 having an opening assembly 100 that is operatively connected to the first embodiment of the gravity sensitive lock assembly 20 described above is shown. As shown in FIG. 3, the weapon container 10 has a container body 80 and a top lid 86. The container body includes a first side section 81, an opposing second side section 82, a bottom section 83 opposed to the top lid 86, a first end section 84, and an opposing second end section 85. As one skilled in the art will appreciate, edge portions of the first side section, the first and second end sections, and the bottom section are connected together along respective common edges. The second side section and the bottom section are pivotally connected together along common edge such that portions of the second side section can be placed into operative contact with side edge portions of the first and second end sections. Similarly, the second side section and the top lid are connected along a common edge (in one example, pivotally connected) such that portions of the top lid may be placed into operative contact with the top edge portions of the respective first and second end sections. In a closed and locked configuration, in which the lock assembly is in the first, locked, position, the respective first and second ends, the bottom, the top lid, and the first and second sides form a closed container.

The interior surfaces of the bottom section, the first and second end sections, the first and second side sections, and the top lid define an interior weapon container cavity 87. A common partition 102 extends from a portion of the interior surface of the first end section to a portion of the interior surface of the second end section and separates the weapon container cavity into a weapon storage compartment 104 and a lock assembly compartment 106. The weapon storage compartment 104 preferably has a weapon holster 106 for secure receipt and storage of a weapon within the interior of the weapon container 10.

The weapon container 10 may also have a view port 110 to allow for visual inspection of the presence of the weapon within the weapon container 10. The view port 110 is sized so that the weapon cannot be removed through the view port and is preferably covered with a penetration resistant and optically translucent material. Further, the weapon container 10 may also have an electrical connection (not shown) in communication with an electrical power source and a weapon power source, such as, for example, the power source for an electrical discharge weapon.

The weapon container 10 shown in FIG. 7 may be mounted onto any surface of the aircraft and allows for ready access to the weapon contained therein upon the application of the predetermined level of the accelerated positive gravitational condition, which moves the first embodiment of the lock assembly 20 from the first, locked, position to the second, unlocked, position, and upon the application of operator force to the container opening assembly 100 of the weapon container 10.

As shown in FIGS. 7–10, the opening assembly 100 of the weapon container 10 includes at least one hinge bar 120 and a handle member 130. The hinge bar 120 is pivotally connected to the bottom surface of the top lid and is in selective locking contact with a flange 122 depending substantially perpendicular from a top edge of the first side portion of the weapon container 10. The flange 122 defines at least one opening 124 extending therethrough that is sized for selective operative receipt of an upwardly extending male protrusion 126 proximate the distal end of the hinge bar 120. The top lid of the weapon container 10 defines an opening 132 that is complementarily sized for receipt of the handle member 130. In the closed and locked configuration, the handle member 130 is connected to a portion of the hinge bar 120 so that it is substantially co-planer with respect to the top lid of the weapon container 10.

A portion of the first end 21 of the locking member 22 of the locking assembly 20 may be in contact with a portion of bottom edge of the hinge bar 120 (preferably proximate the distal end of the hinge bar 120). Alternatively, a stop member 128 may extend between an opposing pair of hinge bars 120 such that a portion of the first end 21 of the locking member 22 may be in contact with a portion of the stop member 128. Thus, in operation, upon the movement of the locking assembly 20 from the first, locked, position to the second, unlocked, position and the resultant downward movement of the locking member 22 away from the hinge bar 120 or stop member 128, the hinge bar 120, upon the application of force by the operator onto the surface of the handle member 130, may be pivotally rotated inwardly into the interior of the weapons container 10. The inward rotation of the hinge bar 120 allows the male protrusion 126 of the hinge bar 120 that was operatively received therein the opening 124 of the flange 122 in the closed and locked configuration to be withdrawn inwardly toward the interior of the weapon container 10 which disengages the hinge bar 120 of the opening assembly 100 from the flange 122. Then, as shown in FIG. 7, the weapon container 10 may be opened for access to the weapon storage compartment 104.

As one skilled in the art will appreciate, the weapon container 10 cannot be opened without the application of an accelerated positive gravitational level of sufficient magnitude because the hinge bar 120 is constrained from the necessary rotational movement due to its operative contact with the first end 21 of the locking member 22 of the first embodiment of the lock assembly 20. Since no downward movement of the locking ember 22 is provided for when the lock assembly is in the first, locked, position (and the knuckle assembly 26 is in the first over-center position), the handle member 130 cannot be "pushed" and the connected hinge bar 120 cannot be "pushed inwardly" into the interior of the weapon container 10. Thus, the male protrusion 126 of the hinge bar 120 is retained within the opening 124 in the flange 122 of the weapon container 10.

Referring now to FIGS. 11–13D, a second embodiment of a weapon container 12 having a container opening assembly 200 operatively connected to the first embodiment of the gravity sensitive lock assembly 20 described above is shown. As shown in FIG. 7, the weapon container 12 has a container body 90 and a top lid 96. The container body includes a first side section 91, an opposing second side section 92, a bottom section 93 that opposes the top lid, a first end section 94, and an opposing second end section 95. As one skilled in the art will appreciate, edge portions of the first and second side sections, the first and second end sections, and the bottom section are connected together along respective common edges.

Each of the first and second side portions of the weapon container 12 may have a flange 202 depending substantially perpendicular therefrom the respective top edge of the first and second side portions. Each flange 202 defines a plurality of openings 204. As one skilled in the art will appreciate, each opening 204 provides for operative receipt of a fastener 98 for connection of the weapon container 12 to aircraft equipment railings. In a closed and locked configuration, in which the lock assembly 20 is in the first, locked, position, the respective first and second ends, the bottom, the top lid, and the first and second sides form a closed weapon container 12.

The interior surfaces of the bottom section, the first and second end sections, the first and second side sections, and the top lid define an interior weapon container cavity 97. The weapon container 12 may have a view port (not shown) in the top lid to allow for visual inspection of the presence of the weapon within the container cavity. The view port is preferably sized so that the weapon cannot be removed through the view port and is preferably covered with a penetration resistant and optically translucent material. Further, the weapon container 12 may also have an electrical connection (not shown) in communication with an electrical power source and a weapon power source, such as, for example, the power source for an electrical discharge weapon.

The weapon container 12 shown in FIG. 11 allows for ready access to the weapon contained therein upon the application of the targeted accelerated positive gravitational condition, which moves the first embodiment of the lock assembly 20 from the first, locked, position to the second, unlocked, position, and upon the application of operator force to the container opening assembly 200 of the weapon container 12. In operation, upon movement of the lock assembly 20 from the first, locked, position to the second, unlocked, position, the opening assembly 200 of the weapon container 12 is actuated by the operator so that the top lid may be moved relative to the top edges of the side and end portions of the weapon container 12. In one example, the top lid is pivotally connected along a common edge to one of the side portions of the weapon container 12 so that the interior of the weapon container 12 may be accessed by pivoting the top lid about the common edge after the opening assembly 200 is actuated.

Alternatively, in an example of the weapon container 12 shown in FIGS. 12A–12D, the weapon container 12 may also have a tray system 250 slidably disposed therein the cavity of the weapon container 12. In this example, the tray system 250 is connected to a portion of the bottom surface of the top lid of the weapon container 12. The tray system 250 preferably has a weapon holster for secure receipt and storage of the weapon within the interior cavity of the weapon container 12.

In operation, a tee handle member 222, which is operatively connected to the top lid of the weapon container 12 and forms a portion of the opening assembly 200, is pulled upwardly along the longitudinal axis of the weapon container 12. As the top lid is drawn upwardly away from the top edges of the side and end portions, a base tray of the tray system 250 is drawn up toward the top edges of the side and end portions until a limit stop is reached. When the limit stop is reached, the top lid is pivoted to the side around a pivot 252 in the tray system 250 and the weapon is exposed.

The container opening assembly 200 of the second embodiment of the weapon container includes a hinge plate 224, an actuation button 226, at least one latch plate 228, and the tee handle member 222. As shown in FIG. 11, the top lid of the weapon container 12 defines at least two openings. The top end of the actuation button 226 extends through one of the openings and is positioned above the top surface of the top lid. Similarly, the top, T-shaped, portion of the tee handle member 222 is positioned above the top surface of the top lid for actuation by the operator. As one will appreciate, substantially all of the other portions of the container opening assembly 200 for the second embodiment of the weapon container 12 are concealed beneath the top lid of the weapon container 12 when the weapon container 12 is in a closed and locked configuration.

Referring to FIGS. 13A–13D, the actuation button 226 defines a slot 227 intermediate the top and bottom ends of the actuation button 226. The tee handle member 222 has a rod 223, which is connected to the top, T-shaped, portion of the tee handle member 222, and a semicircular flange 221 that extends substantially perpendicular from a portion of the rod 223. The edge of the semicircular flange 221 has an arcuate cutout 230 shaped to be complementary to at least a portion of the exterior surface of the actuation button 226. Thus, in operation, when the actuation button 226 is in a first, fully extended, position, at least a portion of the exterior surface of the actuation button 226 intermediate the slot 227 and the bottom end of the actuation button 226 is in contact with the actuate cutout 230 in the edge of the semicircular flange 221 of the tee handle member 222. Because of the interference between the arcuate cutout 230 and the actuation button 226, the tee handle member 222 is prevented from being rotated about its longitudinal axis when the actuation button 226 is in the first, extended, position.

Each latch plate 228 has at least one male protrusion 229 extending from one edge of the latch plate 228. Each male protrusion 229 is operative received within a complementarily sized slot 240 defined in the side portion of the weapon container 12 proximate the top end of the side portion. In one example, a single latch plate 228 is used and the top lid is pivotally connected along a common edge to one side portion of the weapon container 12. As one will appreciate, the slot 240 for engagement of the male protrusion 229 of the latch plate 228 would be in the opposing side portion of the weapon container 12.

In another example, as shown in FIGS. 13A–13D, a pair of opposing latch plates 128 may be used. The pair of opposing latch plates 228 are in partial overlying registration and are operatively connected to the tee handle member 222. In this example, the male protrusions 229 of the respective latch plates 128 would be operatively received within slots 240 in the respective opposing-side portions. As one skilled in the art will appreciate, upon rotation of the tee handle member 222 about its longitudinal axis, the edge of the each latch plate 228 having a male protrusion 229 is drawn inward toward the tee handle member 222. The movement of the latch plate 228 causes the male protrusion of the latch plate 228 to be withdrawn from the slot 240 in the weapon container 12 so that the top lid may be operatively removed to expose the interior of the weapon container 12.

To effect rotational movement of the tee handle member 222, the slot 227 in the actuation button 226 is sized for operative receipt of a portion of the edge of the flange 221 of the tee handle member 222. When the actuation button 226 is positioned in a second, depressed, position, the slot 227 is positioned substantially coplanar with the flange 21 of the tee handle member 222 for receipt of the edge of the flange 221. This allows for the operative rotation of the tee handle member 222 about its longitudinal axis which will, as noted above, cause the latch plates 128 to retract and release from the engaged portions of the weapon container 12.

Thus, in order for the weapon container 12 to be opened, the actuation button 226 must be moved from the first, extended, position, to the second, depressed, position. The hinge plate 224 is pivotally connected to the bottom surface of the top lid. A portion of the hinge plate 224 is in selective contact with the bottom surface of the actuation button 226 so that downward pivotal movement of the hinge plate 224 will allow the actuation button 226 to be depressed from the first, extended, position to the second, depressed, position. A portion of the bottom surface of the hinge plate 224 is in operative contact with a portion of the first end 21 of the locking member 22 of the first embodiment of the lock assembly 20 so that, when the lock assembly 20 is in the first, locked, position, the hinge plate 224 is constrained from pivotal movement relative to the bottom surface of the top lid so that the actuation button 226 is maintained in the first, extended, position and the tee handle member 222 cannot be turned.

As one will appreciate, the actuation button 226 cannot be forced, through application of an external force to the top end of the actuation button 226, from the extended position to the depressed position, until the lock assembly 20 moves from the first, locked, position to the second, unlocked, position. As one will further appreciate, when the lock assembly 20 moves to the unlocked position upon application of an accelerated gravity condition of sufficient magnitude, the hinge plate 224 pivots down and away relative to the bottom of the top lid which allows the actuation button 226 to be depressed from the extended position to the depressed position.

Figure 14:
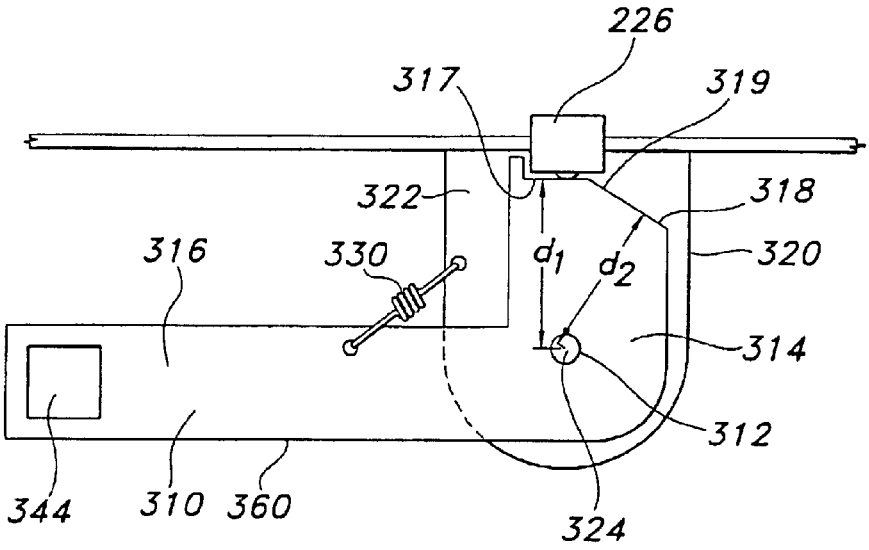
FIG. 14 is a partial front view of a second embodiment of a gravity sensitive lock assembly for a weapon container, the lock assembly having a pivotally mounted pendulum in operable contact with a portion of an opening assembly, the lock assembly shown in a first, locked, position.
Figure 15:
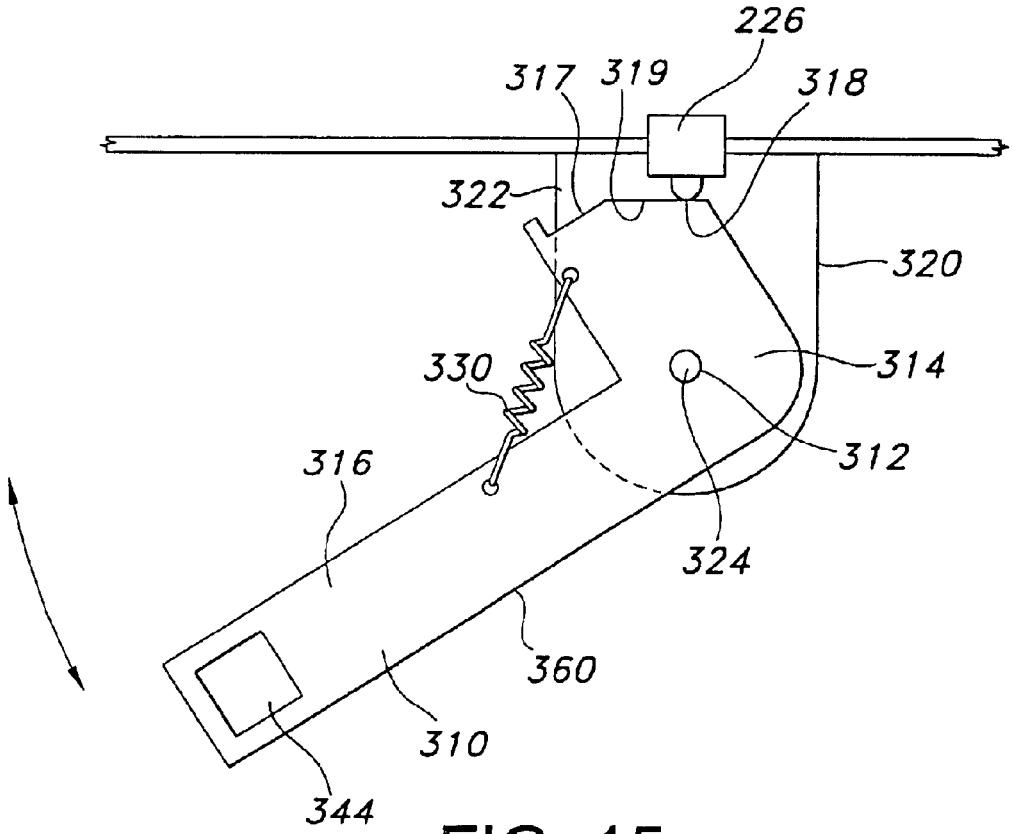
FIG. 15 is a partial perspective view of the second embodiment of a gravity sensitive lock assembly, the lock assembly shown in a second, unlocked, position.

Referring now to FIGS. 14 and 15, a second embodiment of a gravity sensitive lock assembly 300 for a weapon container is shown. The second embodiment of the gravity sensitive lock assembly 300 includes a pendulum member 310, a mounting boss 320, and a spring 330. The mounting boss 320 has a pair of opposing flanges 322 connected to the bottom surface of the top lid of the weapon container. The flanges 322 extend substantially perpendicular from the bottom surface of the top lid. The mounting boss 320 further includes a pivot pin 324 mounted to and extending therebetween the opposing flanges 322 such that the axis of the pivot pin 324 is substantially parallel to the bottom surface of the top lid.

The pendulum member 310 defines a bore 312 for operative receipt of the pivot pin 324 so that the pendulum member 310 is pivotally mounted to the mounting boss 320.

The pendulum member 310 is preferably made of a relatively heavy material and is movable with respect to the mounting boss 320 to the gravitational force applied to the locking assembly 300. The pendulum member 310 has a short arm 314 and a long arm 316 formed in a generally "L" shape. The bore 312 of the pendulum member 310 is proximate the juncture of the long arm 316 and the short arm 314 of the pendulum member 310. The short arm 314 is in the form of a two connected quadrants of a two different sized disks and has a first arcuate edge surface 317 circumscribing an arc of approximately 3 to 30°, a second arcuate edge surface 318 circumscribing an arc of approximately 3 to 30°, and a third edge surface 319 extending between and connecting the first and second arcuate edge surfaces 317, 318. The first arcuate edge surface 318 is spaced from the bore 312 of the pendulum member 310 a first distance $d_1$ and the second arcuate edge surface 318 is spaced from the bore 312 of the pendulum member 310 a second distance $d_2$ which is less than the first distance. As one will appreciate the third edge surface 319 may be tapered to ease the transition from the first arcuate edge surface 317 to the second arcuate edge surface 318.

Figure 10:
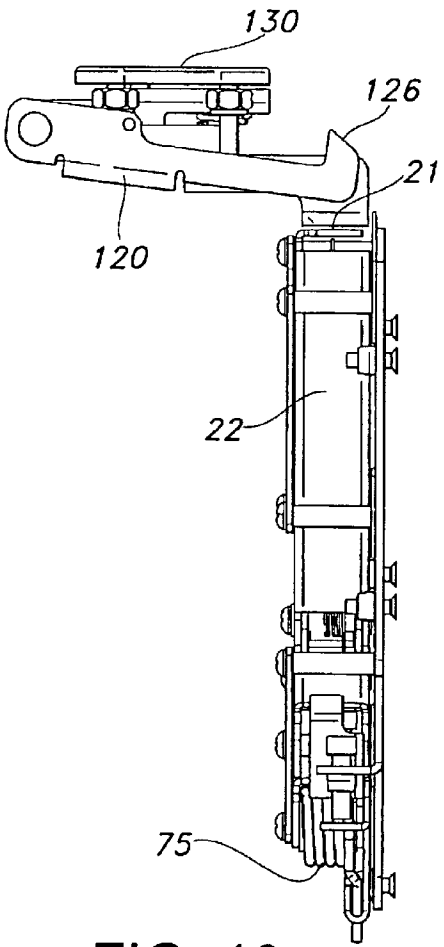
FIG. 10 is a partial side view of the gravity sensitive lock assembly in the second position and showing a portion of the container opening assembly pivoting inwardly to release the top lid of the weapon container.
Figure 9:
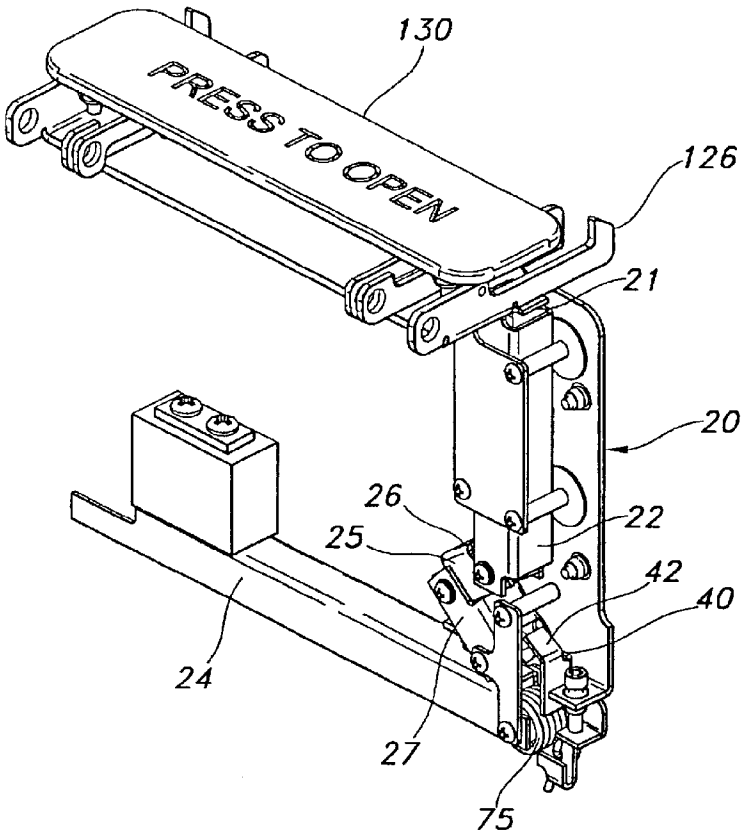
FIG. 9 is a partial perspective view of the first embodiment of the gravity sensitive lock assembly shown in a second, unlocked, position due to the application of an accelerated gravity condition and showing a portion of the container opening assembly pivoting inwardly to release the top lid of the weapon container.

Referring to FIG. 10, the container opening assembly 200 discussed above in respect to the second embodiment of the weapon container 12 is used with the exception that the hinge plate 224 is not required. The second embodiment of the lock assembly 300 is in operative contact with the actuation button 226 of the container opening assembly 200. In FIG. 10, the lock assembly 300 is shown in the first, locked, position, wherein a portion of the bottom of the actuation button 226 in contact with the first arcuate edge surface 317. The spring 330 is connected to a portion of the long arm 316 of the pendulum member 310 intermediate the bore 312 of the pendulum member 310 and the distal end of the long arm 316 to urge the pendulum member 310 into its original position consistent with a normal, unaccelerated, gravity condition. In this original position, a portion of the bottom of the actuation button 226 is in contact with the first arcuate edge surface 317. Thus, in this example, the pendulum member 310 pivot downwardly about the pivot pin 324 against the resistance of the spring 330 upon the application of a positive accelerated gravity condition of sufficient magnitude.

As one would appreciate, a weight 344 may be selectively applied to the long arm 316 of the pendulum member 310 so that a predetermined gravitational force level can be selected for movement from the first, locked, position to the second, unlocked, position. The engagement of the first arcuate edge surface 317 and the bottom of actuation button 226 prevents the actuation button 226 from being depressed from the extended position to the depressed position.

Referring now to FIG. 14, the lock assembly 300 is shown in the second, unlocked, position during the application of the targeted gravitational force level. The application of the gravitational force causes the long arm 316 and the short arm 314 of the pendulum member 310 to pivot with respect to the pivot pin 324 against the resistance of the spring 330. The pivoting of the pendulum member 310 allows the third edge surface 319 of the pendulum member 310 and then, when the targeted gravitation force level is reached, the second arcuate edge surface 318 of the pendulum member 310 to be placed beneath a portion of the bottom of the actuation button 226 (i.e., the second, depressed, position). The bottom of the actuation button 226 is placed into contact with the second arcuate edge surface of the pendulum upon the downward application of force on the actuation button 226 by the operator. It is preferred that the bottom of the actuation button 226 include a bearing so that the pendulum member 310 is freely moveable with respect to the actuation button 226. In this example, the bearing would be the portion of the actuation button 226 that is in contact with the pendulum edge surfaces. The difference between the first and second distances of the respective first and second arcuate edge surfaces 316, 317 is sufficient to place the actuation button 226 in the second, depressed, position when a portion of bottom of the actuation button 226 is in contact with the second arcuate edge surface 318 which allows the flange of the tee handle member 222 to be received within the slot of the actuation button 226.

As one will appreciate, upon the release of pressure upon the actuation button 226 and the reduction of the applied gravitational force below the targeted gravitational force, the bottom of the actuation button 226 will ride sequentially across the second arcuate edge surface 318, the third edge surface 319, until engaging the first arcuate edge surface 317 as the pendulum member 310 pivots back to its original unaccelerated position under the applied force of the spring 330.

Although the illustrative embodiments of the present disclosure have been described herein with reference to the accompanying drawings, it is to be understood that the disclosure is not limited to those precise embodiment, and that various other changes and modifications may be affected therein by one skilled in the art without departing from the scope of spirit of the disclosure. Any and all such changes and modifications are intended to be included within the scope of the disclosure as defined by the appended claims.

What is claimed is:

1. A weapon container for mounting in a vehicle subject to a positive accelerated gravity environment, the vehicle having a longitudinal axis, comprising:

a container body having a top edge and having an interior cavity defined therein;

a top lid;

a container opening assembly constructed and arranged for selective movement of the top lid from an open position to a closed position in which at least a portion of the top lid is received onto at least a portion of the top edge of the container body to substantially enclose the interior cavity; and a lock assembly constructed and arranged for movement between a first, locked, position and a second, unlocked, position upon application of an accelerated gravity condition of a predetermined level, the lock assembly mounted to a portion of an interior surface of the interior cavity, the lock assembly being further constructed and arranged for preventing movement of the container opening assembly when the lock assembly is in the first position and allowing movement of the container opening assembly when the lock assembly is in the second position; the lock assembly further comprising:

a) a substantially planar mounting plate that is affixed to the portion of the interior surface of the cavity, the mounting plate having a first mounting pin extending substantially transverse to the plate, a second mounting pin spaced from the first mounting pin and extending away from the plate, and a third mounting pin spaced from the first and second mounting pins and extending away from the plate;

b) a locking member having a first end, an opposed second end, and having a longitudinal axis L, at least a portion of the first end being constructed and arranged for selective operable contact with a portion of the container opening assembly, the locking member being constructed and arranged for movement along the longitudinal axis L between an extended position and a collapsed position;

c) a lever member constructed and arranged for rotational movement about the actuating pin upon the application of the predetermined level of the accelerated gravity condition, the lever member having a distal end, an opposed proximal end, an upper surface, and a longitudinal axis W, the distal end of the lever member having a weight attached thereto, wherein the lever member defines a bore proximate the proximal end of the lever member, the bore constructed and arranged for receiving the first mounting pin for pivotally connecting the lever member to the first mounting pin of the mounting plate, the lever member further having an actuation arm extending away from a portion of the proximal end of the lever member and extending above the upper surface thereof; and d) a knuckle assembly comprising:

i) a mounting member that is substantially T-shaped and has a first mounting end, an opposed second mounting end, and a third mounting end that is intermediate the first and second mounting ends, the first mounting pin is connected to the first mounting end and the second mounting pin is connected to the second mounting end to fix the mounting member relative to the mounting plate;

ii) a first member;

iii) a second member, each of the respective first and second members having an upper end and a lower end, the lower end of the first member being pivotally connected to the upper end of the second member to form a first joint, the upper end of the first member being pivotally connected to a portion of the second end of the locking member to form a second joint, and the lower end of the second member being pivotally connected to the third mounting pin extending between the third mounting end of the mounting member and the mounting plate to form a third joint that is offset from the longitudinal axis W and is above the upper surface of the lever member, the respective second and third joints being substantially co-axial with respect to the longitudinal axis L of the locking member.

2. The weapon container of claim 1, wherein, in the first position of the lock assembly, the lever member is in a normal, unaccelerated, position in which the longitudinal axis W of the lever member is substantially parallel to the longitudinal axis of the vehicle, said first joint being offset to one side of the longitudinal axis L of the locking member in a first overcenter position so that at least a portion of the second arm is in contact with the second mounting pin of the mounting plate, and the locking member is in its extended position.

3. The weapon container of claim 2, wherein, in the second position of the lock assembly, the lever member rotates about the mounting pin, said first joint is offset to the opposite side of the longitudinal axis L in a second overcenter position that is spaced from the first overcenter position, and the locking member is drawn into the collapsed position.

4. The weapon container of claim 3, further comprising a spring plate mounted onto the first mounting pin intermediate the mounting plate and the lever member, the spring plate having a spring shoulder stop extending away therefrom, wherein the lever member defines a channel, and wherein the lock assembly further comprises a first spring constructed and arranged to urge the lever member into its normal position, the first spring being mounted on the first mounting pin within the channel of the lever member, the first spring having a first spring end portion contacting a portion of the channel of the lever member and a second spring portion contacting a portion of the spring shoulder stop.

5. The weapon container of claim 3, wherein the lock assembly further comprising a pivot pin pivotally connecting the upper end of the first member to the second end of the locking member, and further comprising a second spring constructed and arranged to urge the knuckle assembly back into its first overcenter position, the second spring being mounted on the pivot pin and acting on a portion of the locking member and on a portion of the first member.

6. The weapon container of claims 1, wherein the lever member defines at least one elongate slot proximate the distal end thereof, each slot extending substantially parallel to the longitudinal axis W, and wherein the weight is positioned with respect to the slot to select the predetermined level of the accelerated gravity condition.

7. The weapon container of claim 1, wherein interior surface of the cavity of the container comprises the mounting plate.

8. The weapon container of claim 1, wherein the predetermined level of the accelerated gravity condition is in the range of from about 1.1 to 4.5 Gs.

9. The weapon container of claim 1, wherein the predetermined level of the accelerated gravity condition is in the range of from about 1.1 to 3.5 Gs.

10. The weapon container of claim 1, wherein the predetermined level of the accelerated gravity condition is in the range of from about 1.2 to 2.5 Gs.

11. A gravity-sensitive lock assembly for a weapon container mounted in a vehicle subject to a positive accelerated gravity environment, the weapon container having a container opening assembly connecting a top lid to a container body, the container body having an interior surface and defining an interior cavity, the vehicle having a longitudinal axis, the gravity-sensitive lock assembly comprising:

a) a substantially planar mounting plate that is affixed to a portion of the interior surface of the cavity, the mounting plate having a first mounting pin extending substantially transverse to the plate, a second mounting pin spaced from the first mounting pin and extending away from the plate, and a third mounting pin spaced from the first and second mounting pins and extending away from the plate;

b) a locking member having a first end, an opposed second end, and having a longitudinal axis L, at least a portion of the first end being constructed and arranged for selective operable contact with a portion of the container opening assembly, the locking member being constructed and arranged for movement along the longitudinal axis L between an extended position and a collapsed position;

c) a lever member constructed and arranged for rotational movement about the actuating pin upon the application of the predetermined level of the accelerated gravity condition, the lever member having a distal end, an opposed proximal end, an upper surface, and a longitudinal axis W, the distal end of the lever member having a weight attached thereto, wherein the lever member defines a bore proximate the proximal end of the lever member, the bore constructed and arranged for receiving the first mounting pin for pivotally connecting the lever member to the first mounting pin of the mounting plate, the lever member further having an actuation arm extending away from the proximal end of the lever member and extending above the upper surface of the lever member; and d) a knuckle assembly comprising:

i) a mounting member that is substantially T-shaped and has a first mounting end, an opposed second mounting end, and a third mounting end that is intermediate the first and second mounting ends, the first mounting pin is connected to the first mounting end and the second mounting pin is connected to the second mounting end to fix the mounting member relative to the mounting plate;

ii) a first member;

iii) a second member, each of the respective first and second members having an upper end and a lower end, the lower end of the first member being pivotally connected to the upper end of the second member to form a first joint, the upper end of the first member being pivotally connected to a portion of the second end of the locking member to form a second joint, and the lower end of the second member being pivotally connected to the third mounting pin extending between the third mounting end of the mounting member and the mounting plate to form a third joint that is offset from the longitudinal axis W and is above the upper surface of the lever member, the respective second and third joints being substantially co-axial with respect to the longitudinal axis L of the locking member, wherein the lock assembly is constructed and arranged for movement between a first, locked, position and a second, unlocked, position upon application of an accelerated gravity condition of a predetermined level, wherein the interior cavity of the weapon container is substantially enclosed by the top lid when the lock assembly is in the first position, and wherein movement of the container opening assembly is allowed when the lock assembly is in the second position.

12. The lock assembly of claim 11, wherein, in the first position of the lock assembly, the lever member is in a normal, unaccelerated, position in which the longitudinal axis W of the lever member is substantially parallel to the longitudinal axis of the vehicle, said first joint being offset to one side of the longitudinal axis L of the locking member in a first overcenter position so that at least a portion of the second arm is in contact with a portion of the second mounting pin of the mounting plate, and the locking member is in its extended position.

13. The lock assembly of claim 12, wherein, in the second position of the lock assembly, the lever member rotates about the actuating pin, said first joint is offset to the opposite side of the longitudinal axis L of the locking member in a second overcenter position that is spaced from the first overcenter position, and the locking member is drawn into the collapsed position.

14. The lock assembly of claim 13, further comprising a spring plate mounted onto the first mounting pin intermediate the mounting plate and the lever member, the spring plate having a spring shoulder stop extending away therefrom, wherein the lever member defines a channel, wherein the lock assembly further comprises a first spring constructed and arranged to urge the lever member into its normal gravity position, the first spring being mounted on the first mounting pin within the channel of the lever member, the first spring having a first spring end portion contacting a portion of the channel of the lever member and a second spring portion contacting a portion of the spring shoulder stop.

15. The lock assembly of claim 13, wherein the lock assembly further comprising a pivot pin pivotally connecting the upper end of the first member to the second end of the locking member, and further comprising a second spring constructed and arranged to urge the knuckle assembly back into its first overcenter position, the second spring being mounted on the pivot pin and acting on a portion of the locking member and on a portion of the first member.

16. The lock assembly of claim 11, wherein the lever member defines at least one elongate slot proximate the distal end thereof, and wherein the weight is selectively positioned with respect to the slot to select the predetermined level of the accelerated gravity condition.

17. The lock assembly of claim 11, wherein the predetermined level of the accelerated gravity condition is in the range of from about 1.1 to 4.5 Gs.

18. The lock assembly of claim 11, wherein the predetermined level of the accelerated gravity condition is in the range of from about 1.1 to 3.5 Gs.

19. The lock assembly of claim 11, wherein the predetermined level of the accelerated gravity condition is in the range of from about 1.2 to 2.5 Gs.

* * * * *